United States Patent [19]

Röck et al.

[11] Patent Number: 4,530,547

[45] Date of Patent: Jul. 23, 1985

[54] PULL-OUT GUIDE ASSEMBLY FOR DRAWERS

[75] Inventors: Erich Röck; Josef Brunner, both of Höchst, Austria

[73] Assignee: Julius Blum Gesellschaft m.b.H., Höchst, Austria

[21] Appl. No.: 513,273

[22] Filed: Jul. 13, 1983

[30] Foreign Application Priority Data

Jul. 28, 1982 [DE] Fed. Rep. of Germany ... 8221386[U]

[51] Int. Cl.[3] ..... F16C 29/04

[52] U.S. Cl. ..... 308/3.8

[58] Field of Search ..... 308/3.6, 3.8, 3 R; 312/350, 341 R

[56] References Cited

U.S. PATENT DOCUMENTS

| | | | |
|---|---|---|---|
| 1,604,457 | 10/1926 | Lowe | 308/3.8 |
| 3,456,996 | 7/1969 | Heiniger-Schar | 308/3.6 |
| 3,649,086 | 3/1972 | Vance | 308/3.6 |
| 4,367,906 | 1/1983 | Röck | 312/330 R |
| 4,436,357 | 3/1984 | Röck et al. | 308/3.8 |

*Primary Examiner*—Lenard A. Footland

*Attorney, Agent, or Firm*—Wenderoth, Lind & Ponack

[57] ABSTRACT

A pull-out guide assembly mounted beneath a drawer includes a supporting rail on each side of the drawer with a roller mounted on its front end and a pull-out rail on each side with rollers or a slide on the rear end. On one side of the guide assembly the pull-out rail is held laterally on the roller of the support rail while on the other side the pull-out rail has no lateral guide.

8 Claims, 8 Drawing Figures

PULL-OUT GUIDE ASSEMBLY FOR DRAWERS

FIELD AND BACKGROUND OF THE INVENTION

The invention relates to a pull-out guide assembly for a drawer or the like and including, on each side, a pull-out rail mounted on the drawer and a supporting rail mounted on the body of an article of furniture, the supporting rail at its front and the pull-out rail at its rear being provided with rollers or slides.

Pull-out guide assemblies of this kind facilitate insertion and extraction of drawers into and from the furniture body and permit the drawer to be supported or held in the furniture body in the pulled-out position.

SUMMARY OF THE INVENTION

It is the object of the invention to provide a pull-out guide assembly which requires no space at the sides of the drawer, which can be accomodated in a space-saving manner and ensures lateral guiding of the drawer.

According to the invention this is achieved by guiding the rollers or slides, or one roller and one slide, of the pull-out guide assembly arranged below the drawer bottom in the mounted position, on one side of the drawer in the direction of insertion by means of closely adjacent close-lying vertical flanges of the supporting and pull-out rails, whereas the rollers and slides on the other side of the drawer are arranged with lateral clearance towards one side.

It is advantageously provided that on one side the pull-out rail embraces the roller of the supporting rail with a rounded flange.

An embodiment of the invention provides that slides are fastened to the pull-out rail and that the slide on one side has a horizontal slot, and the slide on the other side has a horizontal slot and a vertical slot, in which slots the supporting rails are guided.

It is further provided that each of the pull-out rails has at least over a part of its length an inverted U-shaped profile which is downwardly open and into which a portion an L-shaped portion of the supporting rail extends form below.

BRIEF DESCRIPTION OF THE DRAWINGS

In the following two embodiments of the invention will be described in more detail with reference to the accompanying of the drawings, in which.

DETAILED DESCRIPTION OF THE INVENTION

Figure 1:
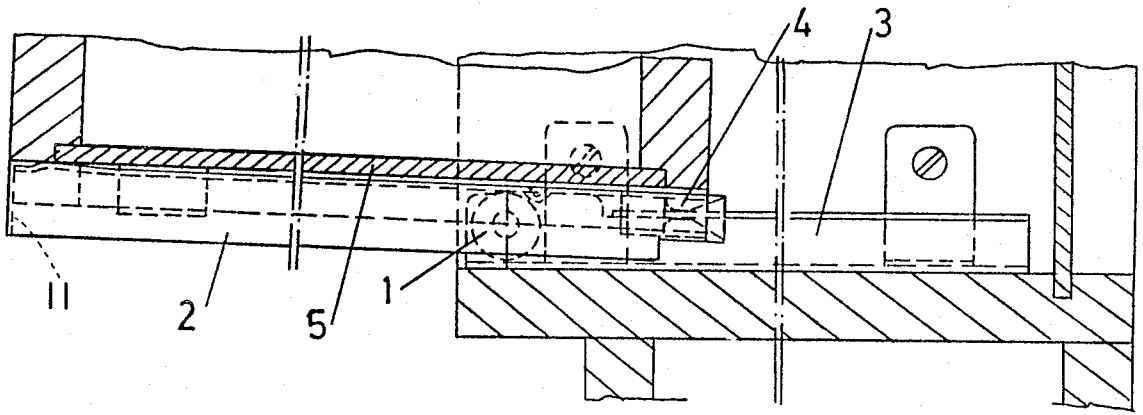
FIG. 1 is a side view, partially in section, of a pull-out guide assembly of a first embodiment of the invention, shown in the pulled-out position.
Figure 2:
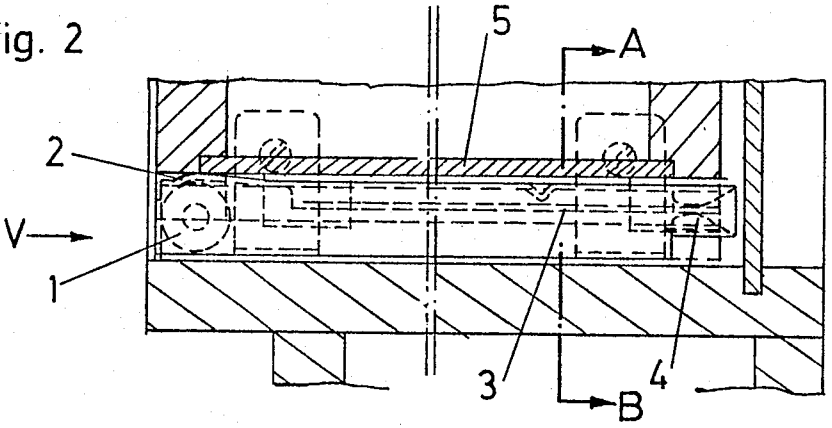
FIG. 2 is a view similar to FIG. 1, but showing the pull-out guide assembly in the inserted position.
Figure 5:
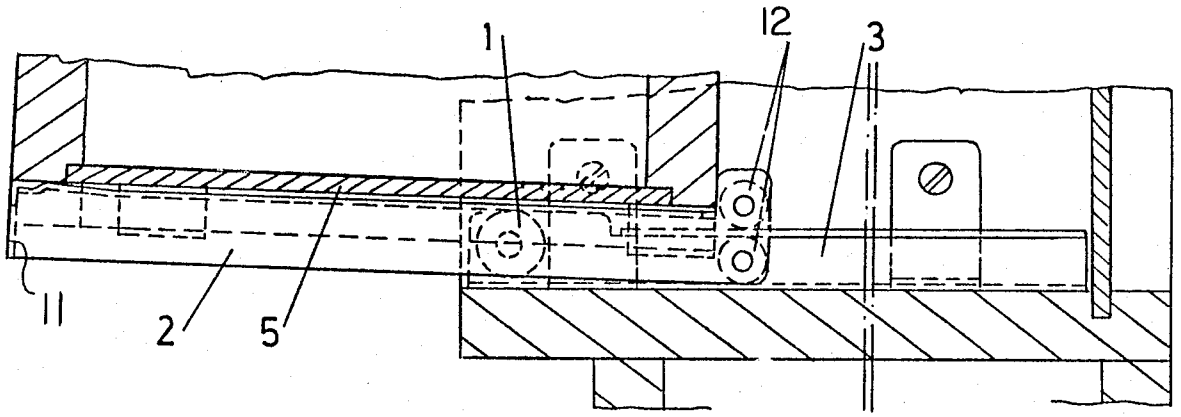
Figure 6:
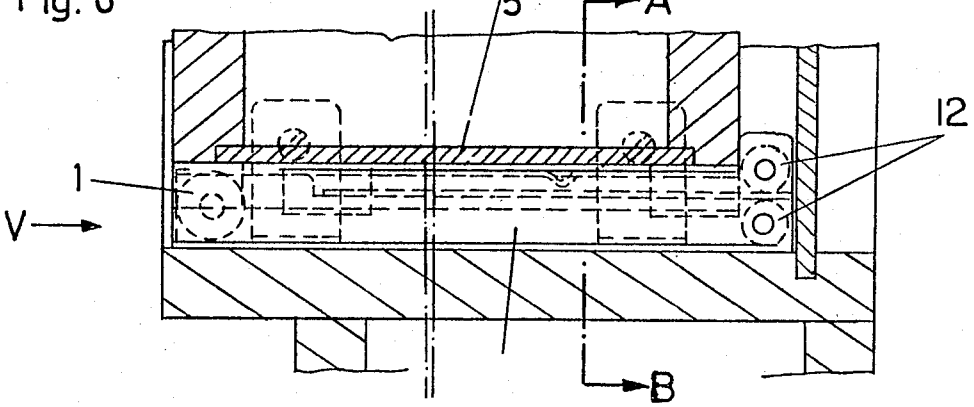
Figure 7:
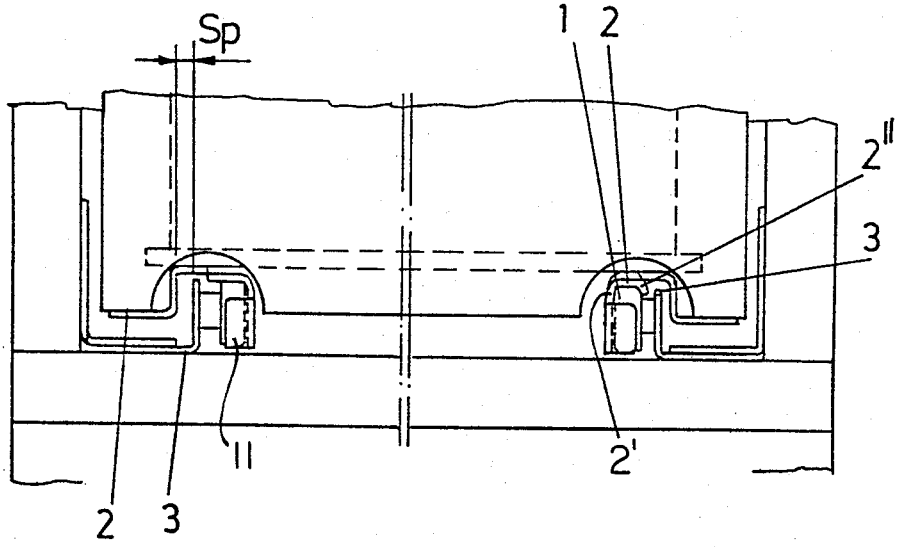
Figure 8:
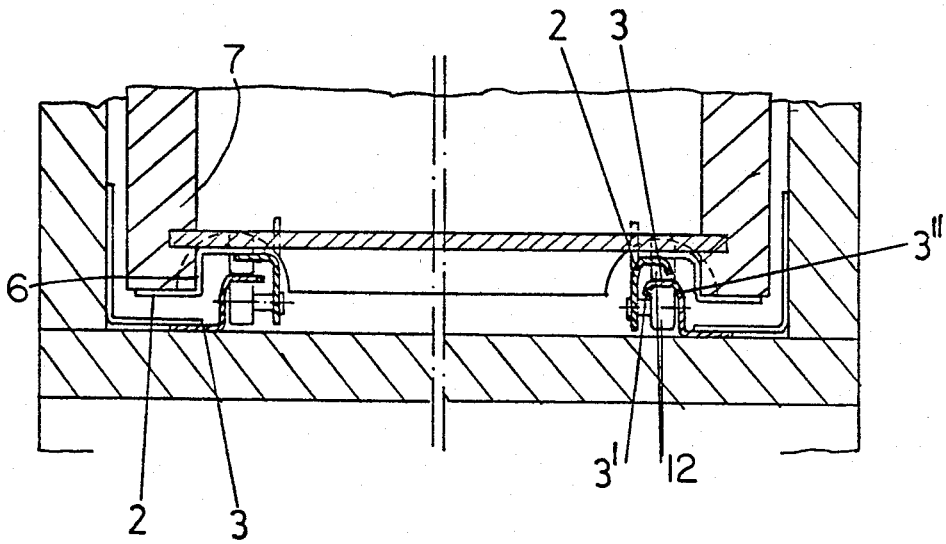

FIGS. 1 and 2 as well as FIGS. 5 and 6 show the right sides of respective pull-out guide assemblies.

A pull-out rail 2 is provided at the side of a drawer, and a supporting rail 3 is provided at the side of the body of an article of furniture. The supporting rails 3 are in a conventional manner fastened to the side walls of the body, e.g. screwed thereto. The pull-out rails 2 on the sides of the drawer are arranged below the bottom 5 of the drawer and are fastened to the drawer side walls 7 by means of fastening flanges 6.

In both embodiments, the front end of each supporting rail 3 is provided with a roller 1.

Figure 3:
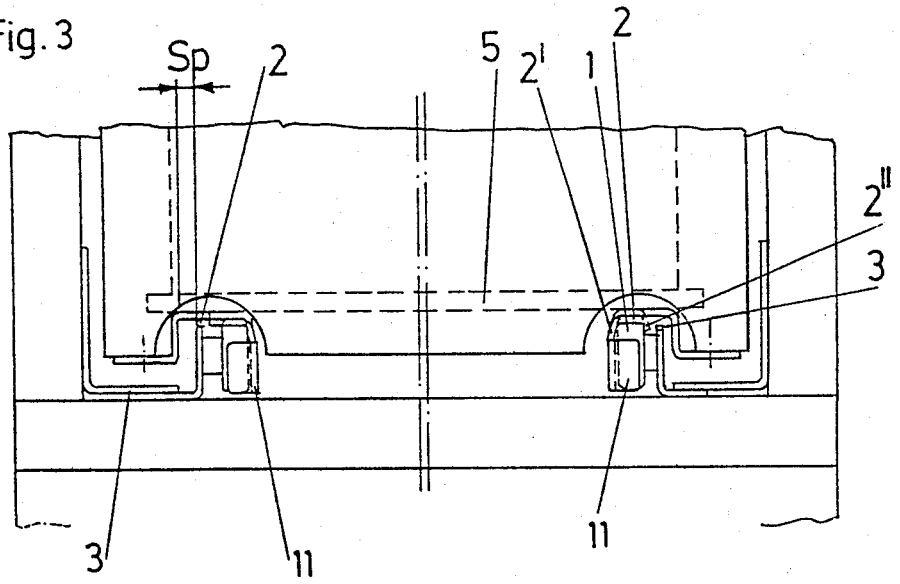
FIG. 3 is an end view in the direction of arrow V of FIG. 2.
Figure 4:
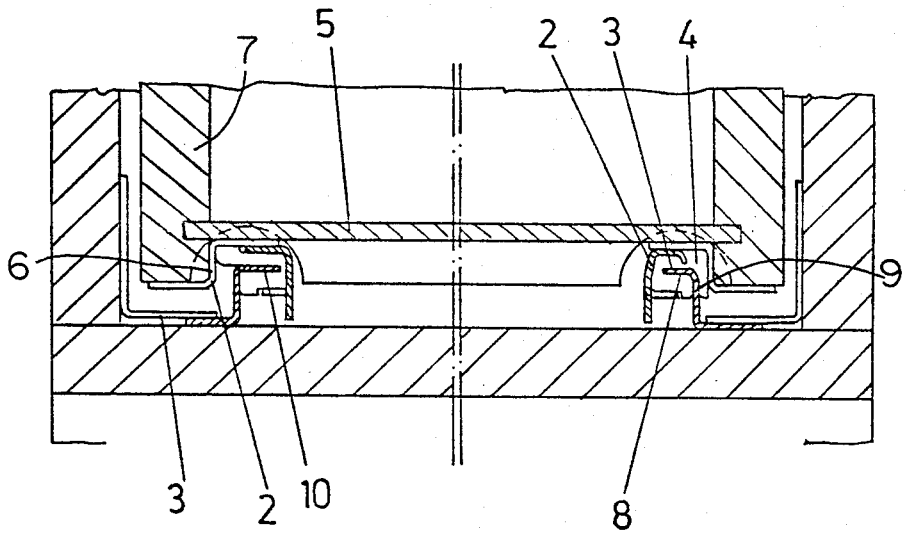
FIG. 4 is a section along line A-B of FIG. 2, and FIGS. 5 to 8 are views similar to FIGS. 1 to 4, respectively, of a second embodiment of the invention.

In the embodiment according to FIGS. 1 to 4 each pull-out rail has at its rear end a slide 4 contacting opposite surfaces of a horizontal flange of the supporting rail. The slide 4 at the right side of the drawer, as viewed in FIGS. 3 and 4, is provided with an L-shaped horizontally as well as vertically extending slot 8 into which extends an L-shaped portion 9 of the supporting rail 3 in the mounted position, thus effecting lateral guiding of the rear end of the drawer.

At the front the pull-out rail 2 has vertical flanges 2', 2" which embrace both sides of the roller 1 in a rounded manner so that here, too, lateral guiding is provided.

At the left side of the drawer the pull-out guide 2 has a lateral clearance Sp with respect to the supporting rail 3 so that tolerances are provided for mounting the pull-out guide assembly because the lateral guiding of the drawer is effected only at one side of the pull-out guide assembly.

The slide 4 at the rear of the left side of the drawer is provided only with a horizontal slot 10 so that here, too, the pull-out rail 2 can move laterally with respect to the supporting rail 3.

The pull-out rails 2 at both sides of the drawer are provided with vertical stops 11 limiting the extent of insertion of the drawer into the body.

The embodiment according to FIGS. 5 to 8 differs from the afore-described embodiment in that the pull-out rails 2 have at their rear sides double roller assemblies 12 instead of the slides 4. Double roller assemblies 12 run along opposite surfaces of a horizontal flange of the supporting rail 3. As can be seen from FIG. 7, the front of this pull-out guide assembly is similar to the afore-described embodiment, i.e. the roller 1 at the right side of the drawer is embraced by the flanges 2',2" of the pull-out rail 2 in a rounded manner, i.e. they fit snugly together.

At the rear of the right side, the lower double roller 12 is in the same manner as the front roller laterally guided by lateral flanges 3',3" so that here, too, lateral guiding of the drawer is provided.

On the left side of the drawer the pull-out rail 2 is again arranged with clearance Sp with respect to the supporting rail 3 so that the lateral guiding of the drawer is exclusively carried out by the right side of the pull-out guide assembly.

Each of pull-out rails 2 has at the front a vertical stop 11 formed by a bent flap of the vertical flange of the rail.

As can be seen form FIGS. 3 and 4 and 7 and 8, each of the pull-out rails 2 has an inverted U-shaped profile which is downwardly open and into which the L-shaped portion of the supporting rail 3 extends from below.

In this manner a highly compact and space-saving arrangement of the rails 2, 3 is obtained.

What is claimed is:

1. In a pull-out guide assembly for guiding movement of a drawer or the like into and out of a body of an article of furniture, said assembly being of the type including first and second arrangements for use on respective first and second sides of the drawer, each said arrangement including a supporting rail adapted to be mounted on a respective side wall of the body of the article of furniture and a pull-out rail adapted to be mounted on a respective side of the drawer, the improvement wherein:

each said supporting rail includes an upwardly extending vertical flange and a horizontal flange extending inwardly from the top of said vertical flange;

each said pull-out rail includes a horizontal flange located above said horizontal flange of the respective said supporting rail;

each said supporting rail has mounted at an outer end thereof a roller in rolling contact with the bottom surface of said horizontal flange of the respective said pull-out rail;

each said pull-out rail has mounted at an inner end thereof guide means for guiding contact with opposite surfaces of said horizontal flange of the respective said supporting rail;

said first arrangement including means for laterally guiding and restricting movement between the respective said pull-out and supporting rails;

said second arrangement including means to enable unrestricted lateral movement between the respective said pull-out and supporting rails; and said rails being constructed such that said rollers and said guide means are positioned beneath the bottom of the drawer.

2. The improvement claimed in claim 1, wherein said guide means comprise slide members mounted on respective said pull-out rails, each said slide member having therein a horizontal groove through which extends said horizontal flange of the respective said supporting rail.

3. The improvement claimed in claim 2, wherein said lateral guiding and restricting means comprises a vertical groove in said slide member of said first arrangement, said vertical flange of said supporting rail of said first arrangement extending through and being laterally guided by said vertical groove.

4. The improvement claimed in claim 3, wherein said lateral guiding and restricting means further comprises vertical flanges extending downwardly from said horizontal flange of said pull-out rail of said first arrangement and embracing opposite sides of said roller of said supporting rail of said first arrangement.

5. The improvement claimed in claim 3, wherein said unrestricted lateral movement enabling means comprises a laterally outwardly open side of said horizontal groove in said slide member of said second arrangement.

6. The improvement claimed in claim 1, wherein said guide means comprise roller assemblies mounted on respective said pull-out rails, each said roller assembly including upper and lower rollers in rolling contact with upper and lower surfaces, respectively, of said horizontal flange of the respective said supporting rail.

7. The improvement claimed in claim 6, wherein said lateral guiding and restricting means comprises vertical flanges extending downwardly from said horizontal flange of said supporting rail of said first arrangement and embracing opposite sides of said lower roller of said roller assembly of said first arrangement.

8. The improvement claimed in claim 7, wherein said lateral guiding and restricting means further comprises vertical flanges extending downwardly from said horizontal flange of said pull-out rail of said first arrangement and embracing opposite sides of said roller of said supporting rail of said first arrangement.

* * * * *